US010366632B1

(12) United States Patent
Tropper et al.

(10) Patent No.: US 10,366,632 B1
(45) Date of Patent: Jul. 30, 2019

(54) SECURITY SEAL

(71) Applicant: Cambridge Security Seals LLC, Pomona, NY (US)

(72) Inventors: Elisha Tropper, Scarsdale, NY (US); Brian Lyle, Katonah, NY (US); Michael Gizzerelli, Newburgh, NY (US); Gurmeet Grover, Oakland, NJ (US)

(73) Assignee: Cambridge Security Seals LLC, Pomona, NY (US)

( * ) Notice: Subject to any disclaimer, the term of this patent is extended or adjusted under 35 U.S.C. 154(b) by 516 days.

(21) Appl. No.: 14/590,272

(22) Filed: Jan. 6, 2015

Related U.S. Application Data

(60) Provisional application No. 61/924,455, filed on Jan. 7, 2014.

(51) Int. Cl.
*G09F 3/03* (2006.01)

(52) U.S. Cl.
CPC ..... *G09F 3/0358* (2013.01)

(58) Field of Classification Search
CPC ..... G09F 3/037; G09F 3/0352; G09F 3/0311; G09F 3/14; Y10T 24/1498; Y10T 292/496; Y10T 292/499; Y10T 24/153; Y10T 292/495; Y10T 24/141; Y10T 292/505
USPC ..... 292/318, 307 R, 309, 319, 321
See application file for complete search history.

(56) References Cited

U.S. PATENT DOCUMENTS 4,093,288 A * 6/1978 Suzuki ..... F16B 2/08 24/16 PB
4,537,432 A * 8/1985 Meeks ..... G09F 3/037 24/16 PB
4,588,218 A * 5/1986 Guiler ..... G09F 3/0311 24/16 PB
4,614,373 A * 9/1986 Niemeijer ..... G09F 3/037 292/318
5,056,837 A * 10/1991 Fuehrer ..... B65D 63/1081 292/307 R
5,513,421 A * 5/1996 Wells ..... B65D 63/1036 24/16 PB
5,568,952 A * 10/1996 Ruegg ..... B65D 63/1081 292/307 A
5,630,252 A 5/1997 Wells
5,636,412 A * 6/1997 Lodi ..... B65D 63/1081 24/16 PB
5,669,111 A 9/1997 Rohaly
6,220,434 B1 * 4/2001 Kubota ..... B65D 63/1081 140/93.2

(Continued)

OTHER PUBLICATIONS

U.S. Appl. No. 14/851,202, filed Sep. 11, 2015 (Grover, Gizzarelli and Tropper) claiming priority to U.S. Appl. No. 62/050,841, filed Sep. 16, 2014.

*Primary Examiner* — Mark A Williams
(74) *Attorney, Agent, or Firm* — Weiss & Arons LLP

(57) ABSTRACT

A tamper evident seal includes an elongated strap having a first end proportioned to engage a locking barrel provided on the second of the elongated strap. The elongated strap includes an array of bumps having flat tops to provide an effective grip for a user. A ramp is provided close to the first end of the elongated strap. When the first end of the elongated strap is inserted low the locking barrel, the ramp covers the end of the locking barrel preventing access to the locking feature which is disposed in the locking barrel.

2 Claims, 15 Drawing Sheets

(56) References Cited

U.S. PATENT DOCUMENTS

| | | | | |
|---|---|---|---|---|
| 6,446,311 | B1 * | 9/2002 | Ueno | G09F 3/14 24/16 PB |
| 8,555,467 | B2 * | 10/2013 | Kelly | B65D 63/1081 24/16 PB |
| 2008/0224485 | A1 * | 9/2008 | Mangone | G09F 3/037 292/319 |
| 2012/0133158 | A1 * | 5/2012 | Zhang | B65D 63/1081 292/307 A |

* cited by examiner

SECURITY SEAL

The present application claims priority from my Provisional Patent Application, titled Security Seal, Ser. No. 61/924,455, filed on Jan. 7, 2014.

FIELD OF THE INVENTION

The present invention relates generally to the field of seals for various containers and more particularly to a security seal which is tamper evident for the protection of goods during transportation or storage.

BACKGROUND OF THE INVENTION

Tamper evident seals are typically used to store containers during shipment in order to provide clear evidence in the event tampering with the container has occurred.

The prior art related to seals includes a number of devices in which seals typically comprise an elongated strip of a plastic material a first end of which is proportioned to engage a locking barrel which is disposed on an intermediate portion of the seal and a tag portion which is disposed on the opposite end of the strip.

The locking barrel forms a one-way lock and after insertion of the first end of the strip, the first end cannot removed from the locking barrel without destroying the seal. The tag portion includes indicia identifying the goods stored in the container.

The disadvantages of the typical prior art seals include the following:

The prior art seals include a plurality of bumps. The oval pattern of bumps is abrasive to the user's fingers when installing the seal on a tote box or other container.

The prior art seals include a flange at the end of the seal. This flange is relatively sharp and tends to result in repetitive use injury to the user.

The typical prior art seal incorporates a longitudinal rib. The longitudinal rib renders the seal uncomfortable for the user's fingers and prevents the intermediate portion from incorporating indicia.

The tag portions at the end of the prior art seal interferes with the convenient stacking of tote boxes or other containers when the prior art seals are installed. When the tag portions are bent to facilitate stacking of totes, the bending of the tag portions tends to result in damage to the tags.

Examples of prior art seals are shown in the following U.S. Patents.

U.S. Pat. No. 5,513,421 to Wells for a "Cable Tie Having An Improved Strap Locking Device" shows a cable tie haying an elongated planar strap extending from a head portion. A first series of protrusions and a second series of protrusions extend along the strap to fictionally engage a wire bundle. A member mounted on a hinge in the head prevents substantial movements of the planar strap in a withdrawal direction.

U.S. Pat. No. 5,630,252 to Wells for a "Cable Tie Having an Improved Strap Body" includes a metallic locking barb which is movably mounted in the head portion of the cable tie. The movable metallic locking barb having a knife edge engages a planar strap which extends from the head. The knife edge of the metallic looking barb engages protrusions on the planar strap to prevent substantial movement of the planar strap in a withdrawal direction.

U.S. Pat. No. 5,669,111 to Rohany for "Cable Tie Having a Strengthened Neck Area" shows a cable tie having an elongated planar strap extending from a head portion. A pair of gussets are provided to strengthen the area adjacent to the head portion.

A major disadvantage of the prior art tamper evident seals is related to the tamper evident feature of the seal. In the prior art tamper evident seal the locking feature is exposed to potential surreptitious tampering. This tampering can result in unwanted opening of the seal, removal or disturbances of the goods stored in the sealed container and restoration of the seal in a manner which disguises the fact that the seal has been opened. This problem is especially severe in the storage and shipment of medicines and other high volume items.

OBJECTS AND SUMMARY OF THE INVENTION

It is an object of the present invention to overcome the disadvantages of the prior art by providing a tamper evident security seal which has an elongated body, a first end which can engage a locking barrel provided on the second end.

Another object of the present invention is to provide a security seal which has a convenient surface for identification indicia.

Another object of the present invention is to provide a security seal which can be held conveniently by user without discomfort or injury to the user's fingers.

Another object of the present invention is to provide a security seal which incorporates a finger grip near one end.

Another object of the present invention is to provide a security seal which has a flat surface for indicia.

Another object of the present invention is to provide a security seal which eliminates the use of protruding tags.

Another object of the present invention is to provide a security seal which incudes one or more holes to weaken the seal allowing the user to easily break the seal.

Another object of the present invention is to provide a security seal in which the locking feature is protected by the seal.

Another object of the present invention is to provide a security seal which must be broken in order to open the seal thereby providing clear evidence in the event of tampering.

Yet another object of the present invention is to provide a security seal which can be manufactured in volume resulting in a relatively low unit cost.

Other objects and advantages of the present invention will be made clear hereinafter.

The present invention overcomes the disadvantages of the prior art by providing a tamper evident security seal which can be used to seal various types of tote boxes or other containers to provide a tamper evident seal. The security seal includes an elongated body of plastic material having a first end proportioned to engage a locking barrel provided on the second end of the security seal. The body includes a pattern of bumps having flat tops instead of serrated tops to prevent injury to the user's fingers. Additionally, a ramp is provided close to the first end to provide an elective finger grip. Identification indicia is provided on the elongated body eliminating the use of the prior art protruding tags. One or more holes are provided close to the first end and are used to weaken the seal, allowing the user to more easily break the seal.

When the first end is inserted into the locking barrel the ramp covers the end of the locking barrel preventing access to the locking feature which is mounted in the locking barrel.

BRIEF DESCRIPTION OF THE DRAWINGS

Additional details of construction of the present invention will be described with reference to the drawings in which.

DETAILED DESCRIPTION OF THE INVENTION

Figure 1:
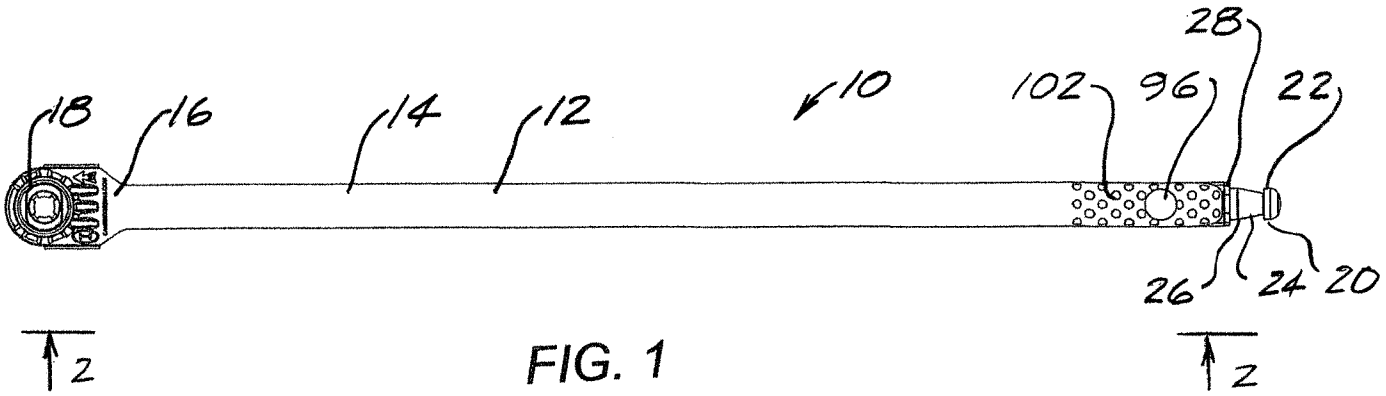
FIG. 1 is a top plan view of a security seal made according to the present invention.
Figure 2:
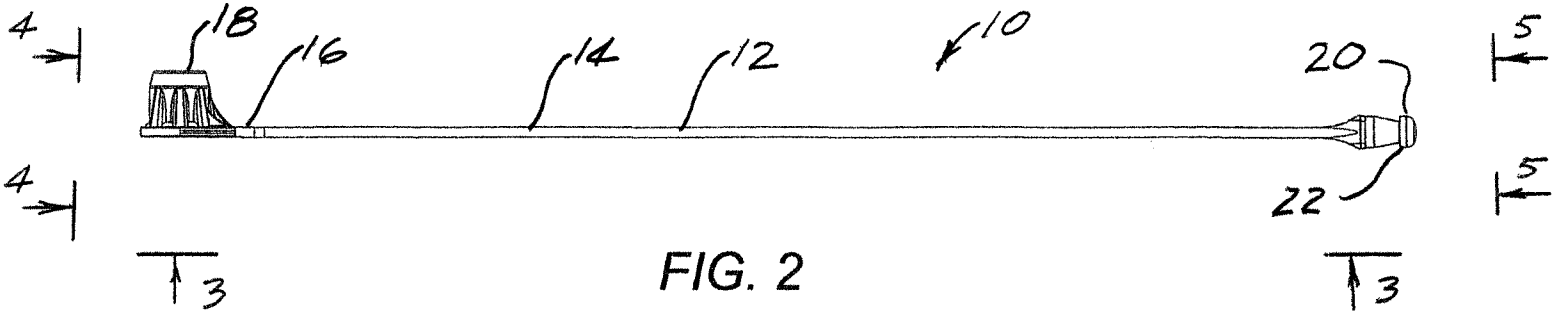
FIG. 2 is a side elevation view taken along the line 2-2 of FIG. 1.

With reference to the drawings, there is shown in FIGS. 1-13 and 15-24 a security seal 10, 300 made in accordance with the present invention. The first embodiment of security seal 10 shown in FIG. 1-24 includes an elongated strap portion 12 which includes a flat portion 14. One end 16 of the elongated portion 12 includes a locking barrel 18 and the opposite end 20 includes an integrally formed locking end 22.

The locking end 22 includes a conical portion 24 the base 26 of which leads to a circular flange 28 which has a pair of flat portions 30, 32.

Figure 7:
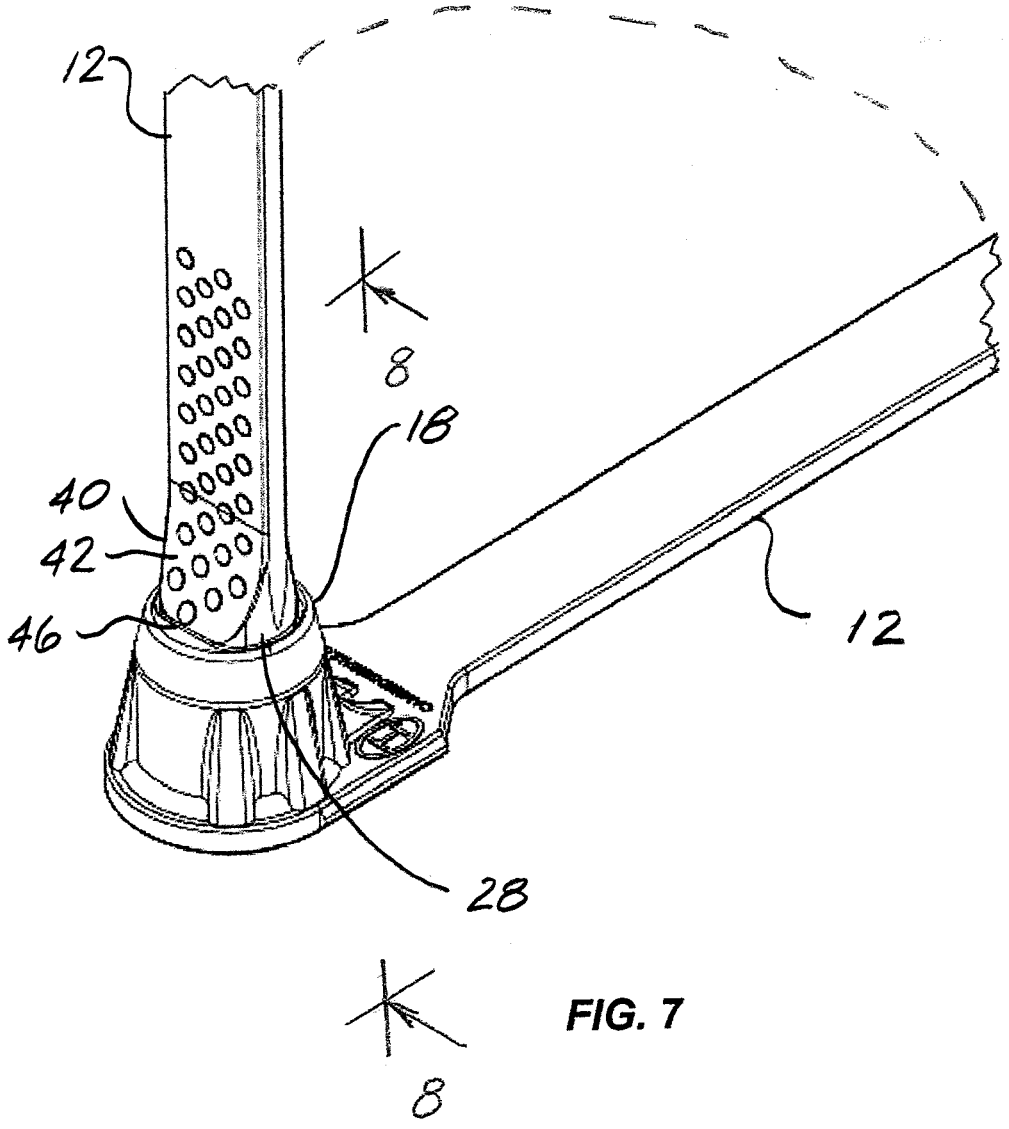
FIG. 7 is a fragmentary perspective view of the security seal of FIG. 1 showing the end of the security seal inserted into the locking barrel and covering the end of the locking barrel.

As is best shown in FIG. 7, when inserted into the locking barrel 18, the flat portions 30, 32 of the flange 28 abut complementary flat portions 34, 36 formed in the locking barrel 18 thereby providing an indexing feature and insuring that the security seal 10 is not twisted.

When inserted into the locking barrel 18, the circular flange 28 covers the top 38 of the locking barrel 18 and prevents unwanted tampering with the security seal 10 such as insertion of lock picking tools or similar tools into the locking barrel 18. The circular flange 28 leads to a ramp portion 40 which comprises a pair of concave surfaces 42, 44 which enable the ramp portion 40 to form a smooth transition between the elongated portion 12 and the circular flange 28.

Figure 5:
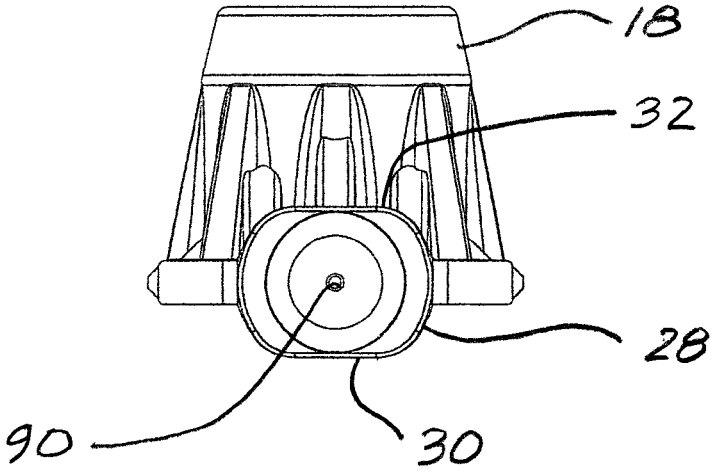
FIG. 5 is an end elevation view taken along the line 5-5 of FIG. 2.
Figure 8:
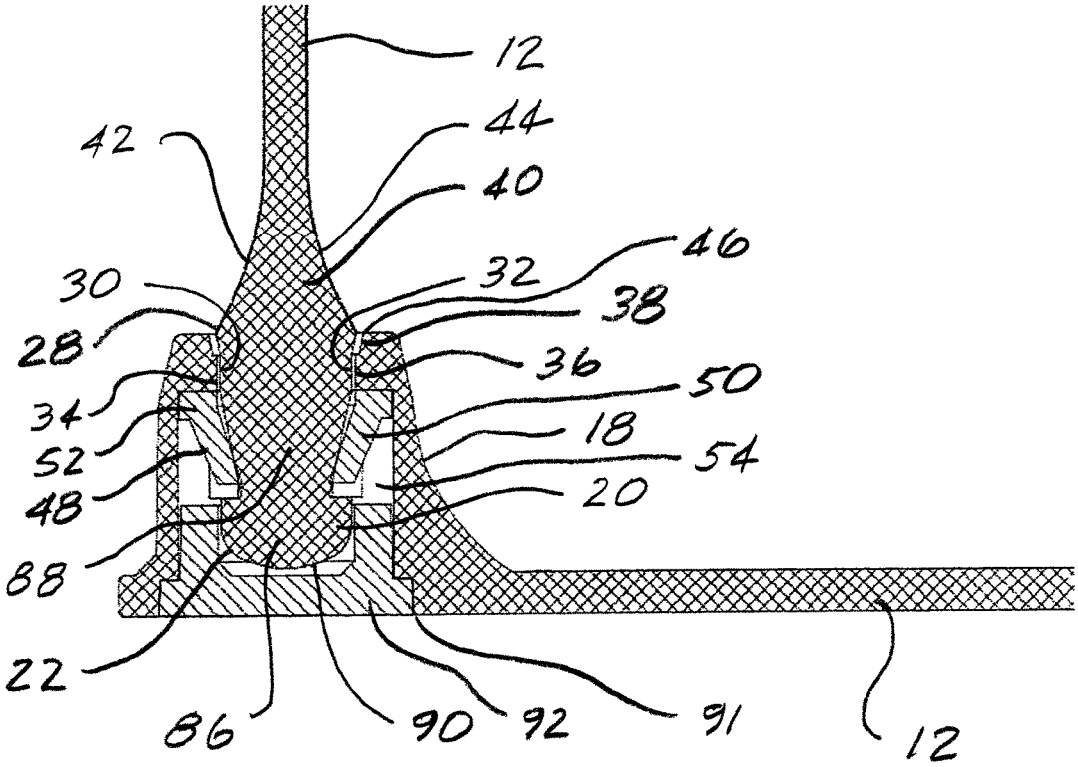
FIG. 8 is a fragmentary cross-sectional view taken along the line 8-8 of FIG. 7.

As is best shown in FIGS. 1, 5, and 7 when the end 20 of the security seal 10 is inserted into the locking barrel 18 the flat portions 30, 32 abut the pair of flat portions 34, 36 which are formed in the opening 46 of the locking barrel 18 as is shown in FIG. 8. As is shown in FIG. 8, the ramp portion 40 covers the opening 46 of the locking barrel 18 and prevents access to the locking teeth 48, 50 which are part of a locking cage 52 which is mounted in the cavity 54 which is formed in the locking barrel 18.

In FIGS. 10-13 the locking cage 52 has been removed from the seal 10 for clarity of illustration. The locking cage 52 is an integrally thrilled member which includes a base 56, four locking teeth 48, 50, 58, 60 which project from the base 56 and four stand-off portions 62, 64, 66, 68 which projects from the base 56. The distal ends 70, 72, 74, 76 of the stand-off portions 62, 64, 66, 68 extend slightly beyond the ends 18, 80, 82, 84 of the locking teeth 48, 50, 58, 60.

The locking end 20 includes a locking cap portion 86 and a tapered portion 88. The locking cap portion 86 has a rounded end 90 as is best shown in FIG. 8.

As is best shown in FIG. 8, the locking teeth 48, 50, 58, 60 can flex and allow entry of the locking cap portion 86 and then snap onto the tapered portion 88. As illustrated, by way of example, in FIGS. 10-13 the four locking teeth 48, 50, 58, 60 are identical.

The locking cap portion 86 is integrally formed on the elongated strap portion 12 and forms a step portion in cooperation with the tapered portion 88.

Once the locking cap portion 86 has been pushed past the locking teeth 48, 50, 58, 60 the locking teeth 48, 50, 58, 60 snap back and the end 22 of the security seal 10 cannot be withdrawn from the locking barrel 18.

The bottom opening 91 of the locking barrel 18 is covered by a cover 92 which is connected to the locking barrel 18 by a spin welding or ultra-sonic welding process.

During the installation of the cover 90, the ends 70, 72, 74, 76 of the four stand-off portions 62, 64, 66, 68 of the locking cage 52 which, as previously described, extends slightly beyond the ends 78, 80, 82, 84 of the locking teeth 48, 50, 58, 60 thereby enabling the locking teeth 48, 50, 58, 60 to flex in order to allow entry of the locking cap portion 86.

All of the possible avenues of access to the locking teeth 48, 50, 58, 60 are thus protected and in attempt to open the locking teeth 48, 50, 58, 60 results in destruction of the security seal 10 and the tampering thus becomes evident.

The security seal 10, according to the present invention shown in FIGS. 1-13, is thus completely tamper evident. Any attempt to gain access to the locking teeth 48, 50, 58, 60 results in the destruction of the security seal 10 and provides clear evidence of tampering.

During use, the ramp portion 40 helps position the user's fingers and provides an effective finger grip. This provides a degree of comfort during use and eliminates the possibility of injury to the user's fingers.

Figure 3:
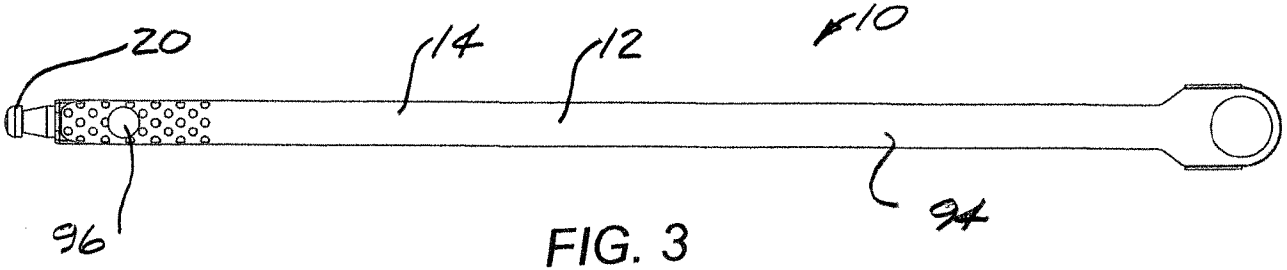
FIG. 3 is a bottom plan view taken along the line 3-3 of FIG. 2.
Figure 4:
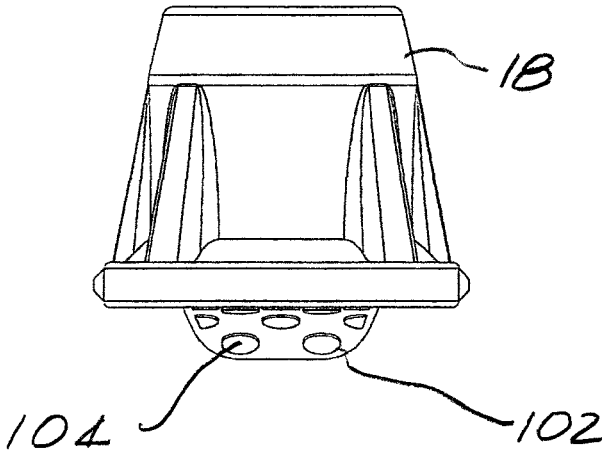
FIG. 4 is an end elevation view taken along the line 4-4 of FIG. 2.
Figure 6:
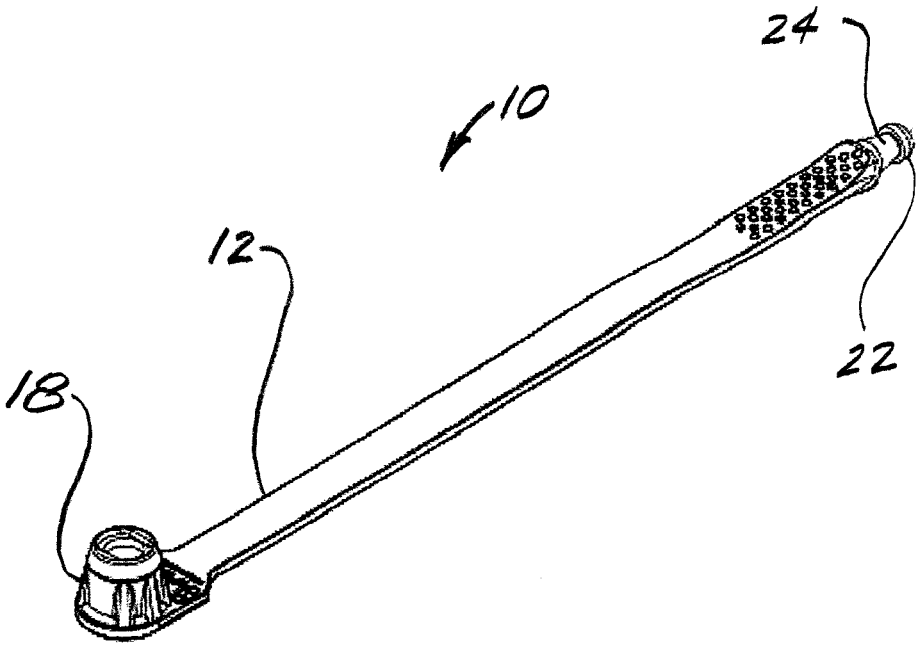
FIG. 6 is an overall perspective view of the security seal of FIG. 1.

A key feature of the invention is the inclusion of a flat surface 94 which contains identification indicia 100 and the elimination of the protruding tag of the prior art seals. The flat surface 94 may incorporate one or more holes 96 of selected size as shown in FIGS. 1 and 3 which selectively weaken the seal 10 to enable a user to break the seal 10 using a predetermined amount of force. The hole 96 facilitates the provision of a seal 10 with a relative close tolerance breaking force. This hole 96 may be omitted as is shown in FIG. 6.

Figure 9:
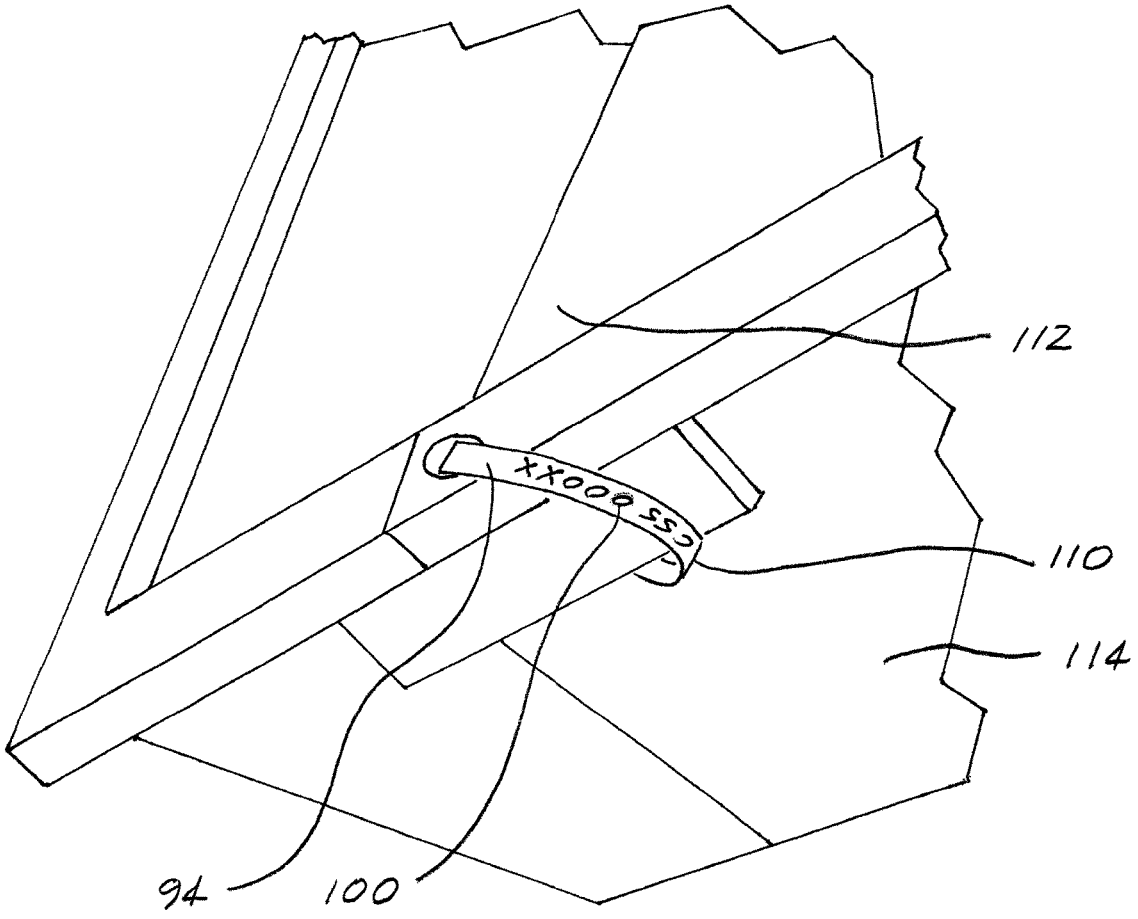
FIG. 9 is a fragmentary perspective view of the security seal of FIG. 1 and a tote box with the security seal shown in use sealing the tote box and showing indicia on the body of the security seal.

The security seal 10, according to the present invention, is provided in a range of lengths. The range of lengths enables a user to apply a seal 110 of selected length which, for example, prevents a tote box cover 112 as shown in FIG. 9 from being opened to form a gap through which goods may be surreptitiously removed from the tote box 114. As shown in FIG. 9, indicia 100 have been formed or printed on an intermediate flat portion 116 of the seal 110.

The curved ramp portion 40, in addition to the helping position the user's fingers to aid the user in inserting the end 22 of the security seal 10 into the locking barrel 18, also helps prevent injury to the user. The curved surfaces 42, 44 of the ramp portion 40 accommodates the natural curved surfaces of the users fingers and reduces the possibility of discomfort or repetitive stress types of injuries. The ramp portion 40 includes a plurality of projections 102. Each of the projections 102 has the general form of a truncated cone with a flat top portion 104. The projections 102 aid a user in grasping the seal 10 without causing injury to the skin.

The security seal 10 can be effectively fabricated in volume using a moldable plastic material.

Figure 10:
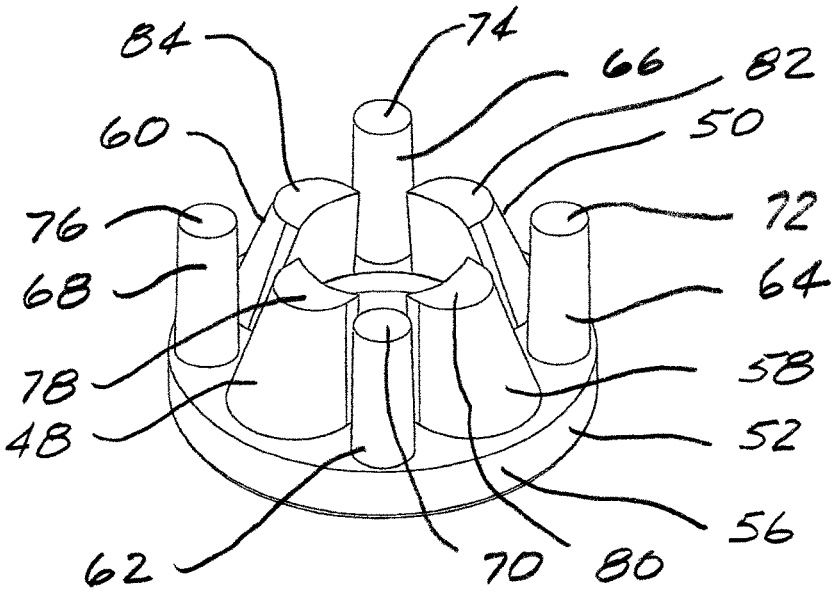
FIG. 10 is a perspective view of the locking cage shown removed from the security seal for clarity of illusion.
Figure 11:
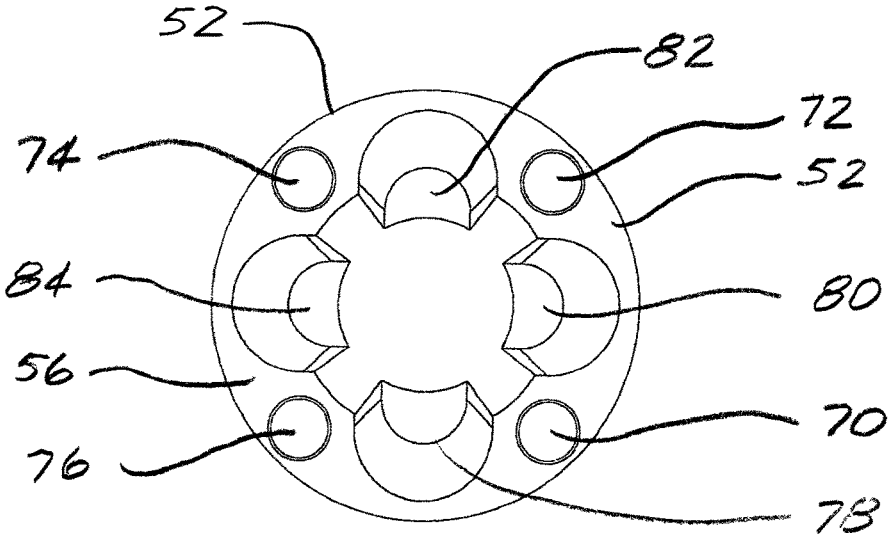
FIG. 11 is a top plan view of the locking cage of FIG. 10.
Figure 12:
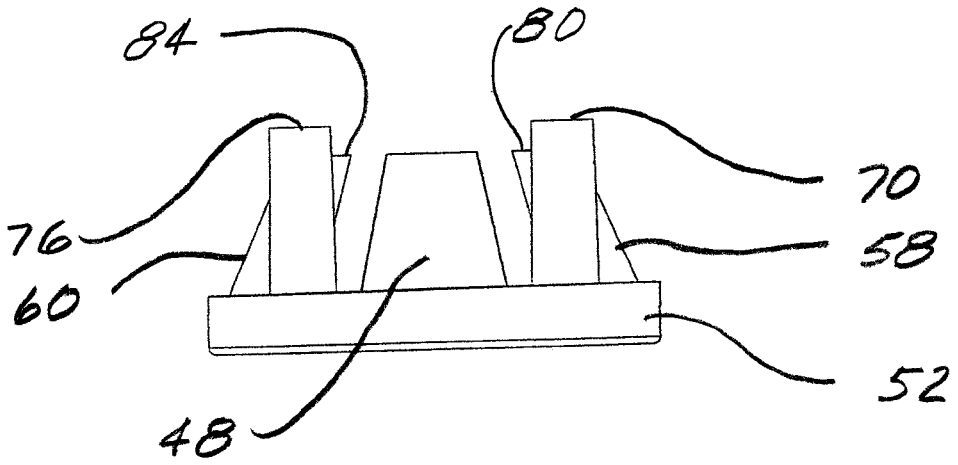
FIG. 12 is a side elevation view of the locking cage of FIG. 10.
Figure 13:
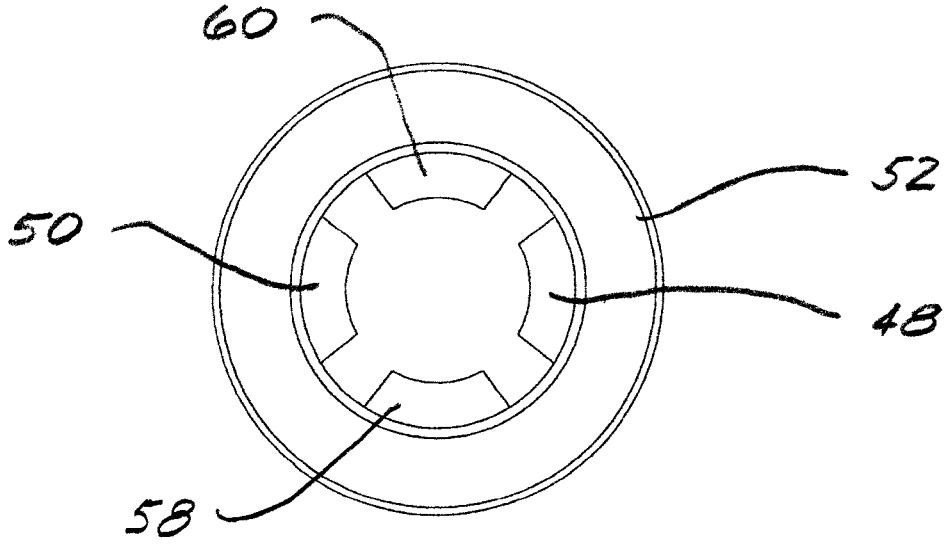
FIG. 13 is a bottom plan view of the locking cage of FIG. 10
Figure 14:
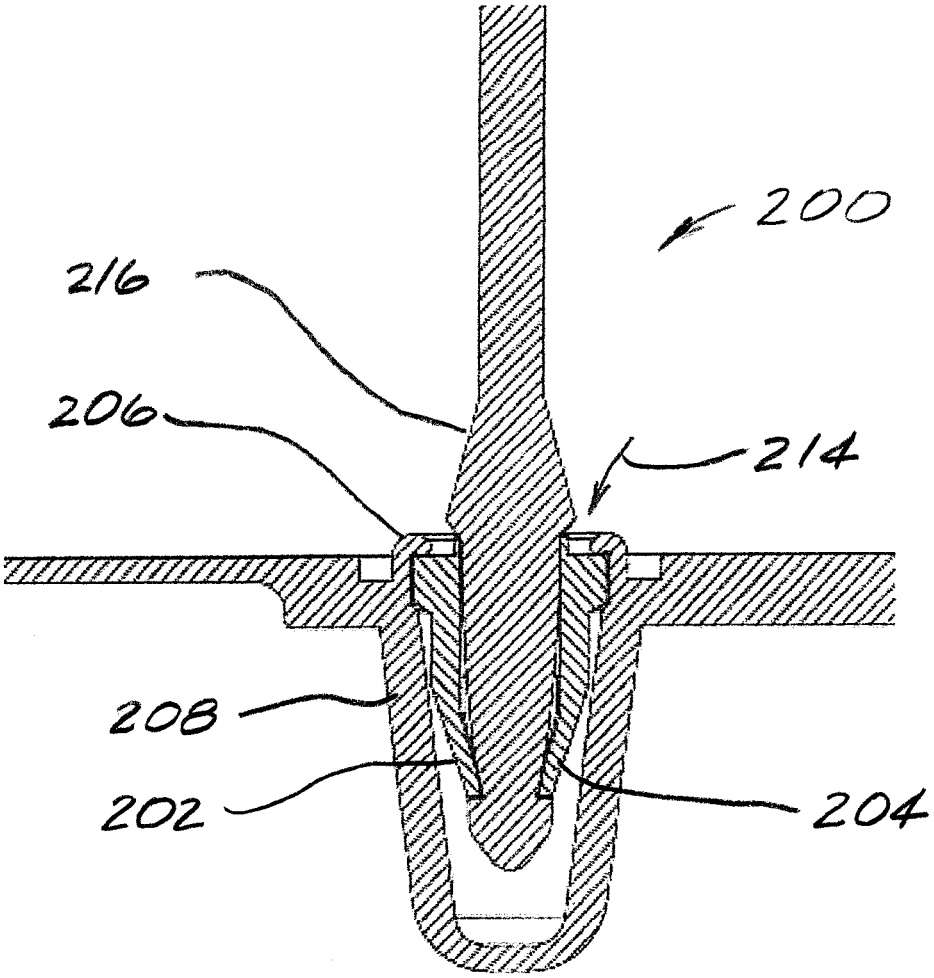
PRIOR ART FIG. 14
FIG. 14 is a fragmentary cross-sectional view of a typical prior art seal.
Figure 15:
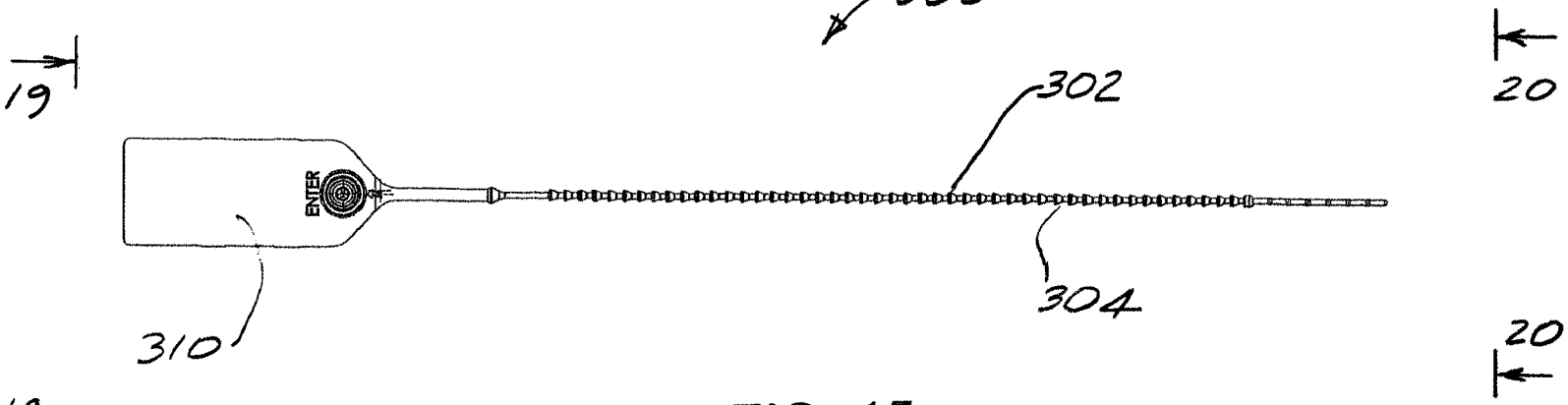
FIG. 15 is a top plan view of an alternative embodiment of the security seal of FIG. 1.
Figure 16:
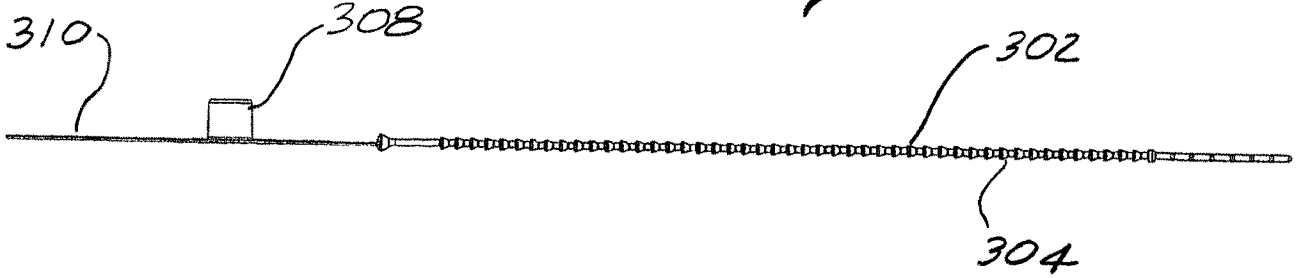
FIG. 16 is a side elevation view taken along the line 16-16 of FIG. 15.
Figure 17:
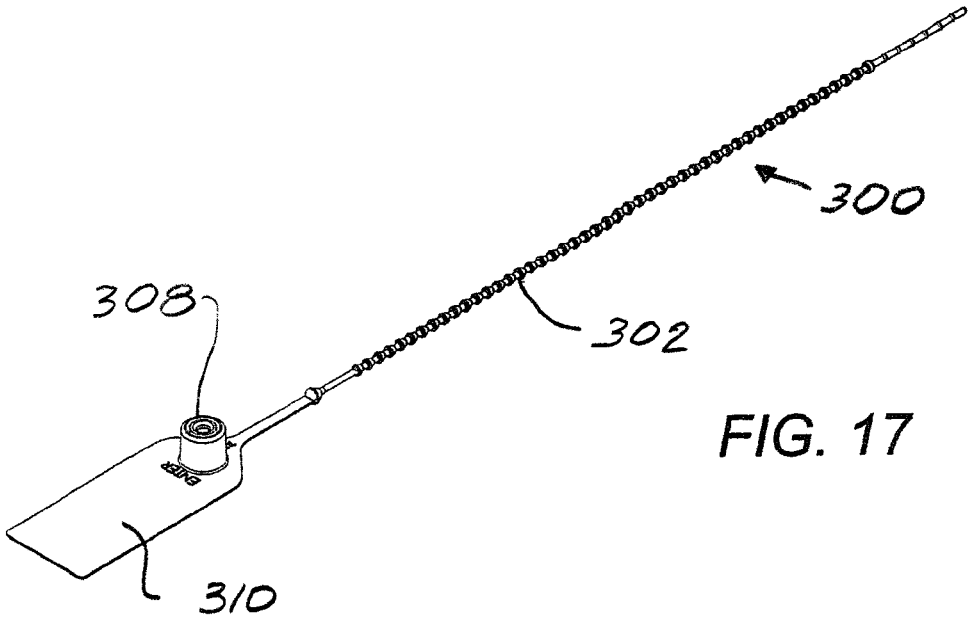
FIG. 17 is a perspective view of the seal of FIG. 15 showing the top of the seal.
Figure 18:
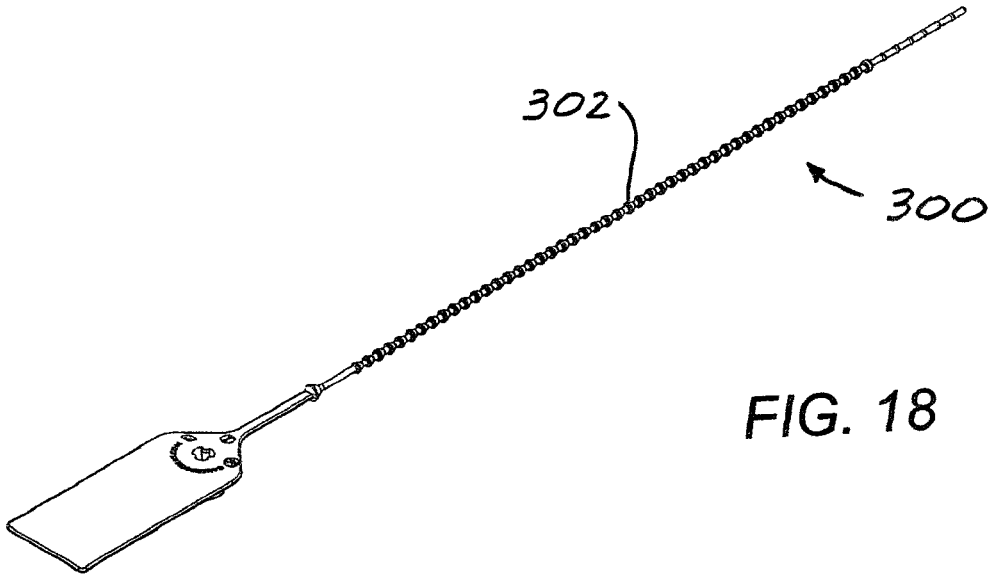
FIG. 18 is a perspective view of the seal of FIG. 15 showing the bottom of the seal.
Figure 19:
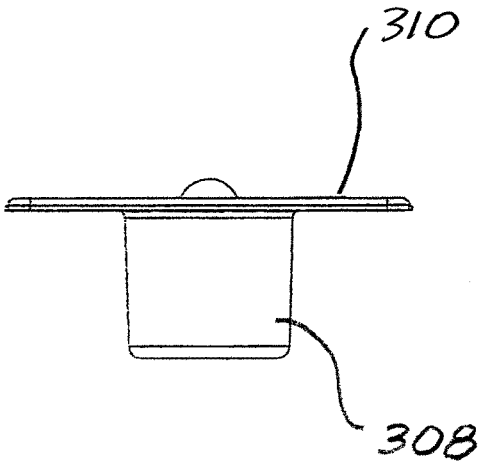
FIG. 19 is an end view of the seal of FIG. 15 taken along the line 19 of FIG. 15.
Figure 20:
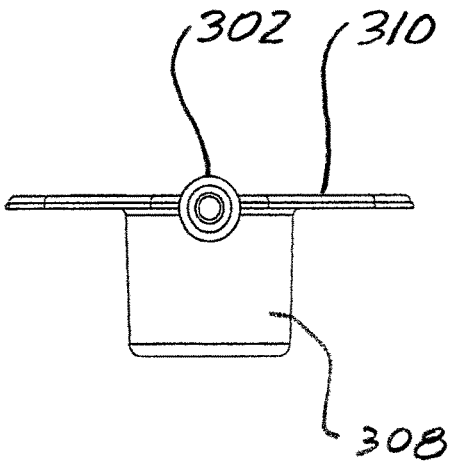
FIG. 20 is an end view of the seal of FIG. 15 taken along the line 20-20 of FIG. 15.

A cross-sectional of a typical prior art seal 200 is shown in FIG. 10. As shown in FIG. 10 in the prior art seal 200, the locking teeth 202, 204 are covered by a rolled flange 206 which is part of the locking barrel 208. The flange 206 may be unrolled or forced opened by inserting a tool in the space between the flange 206 and the end of the sealing strip 212 as illustrated by the arrow 21*d*. After tampering, the flange 206 may repaired by forcing the flange 206 to return to the original position shown in FIG. 14. This type of seal 200 thus provides a lower degree of tamper evident protection because the seal 200 can be surreptitiously opened and reclosed without providing clear evidence of the tampering which has occurred.

FIGS. 15-24 show an alternative embodiment of the invention which is identified as a one-piece seal 300.

As is best shown in FIGS. 15-24, the one-piece seal 300 is an integrally formed unitary member which has an elongated strap portion 302 having a plurality of generally conical ramp-like portions typically identified by the referenced numeral 304. Each of the ramp-like portions 304 is outwardly flared and has a base portion 306 and a conical portion 307 which leads to the next adjacent ramp-like portion 304.

A generally cylindrical portion which is typically identified by the reference numeral 326 is disposed between adjacent ramp-like portions 304.

Figure 22:
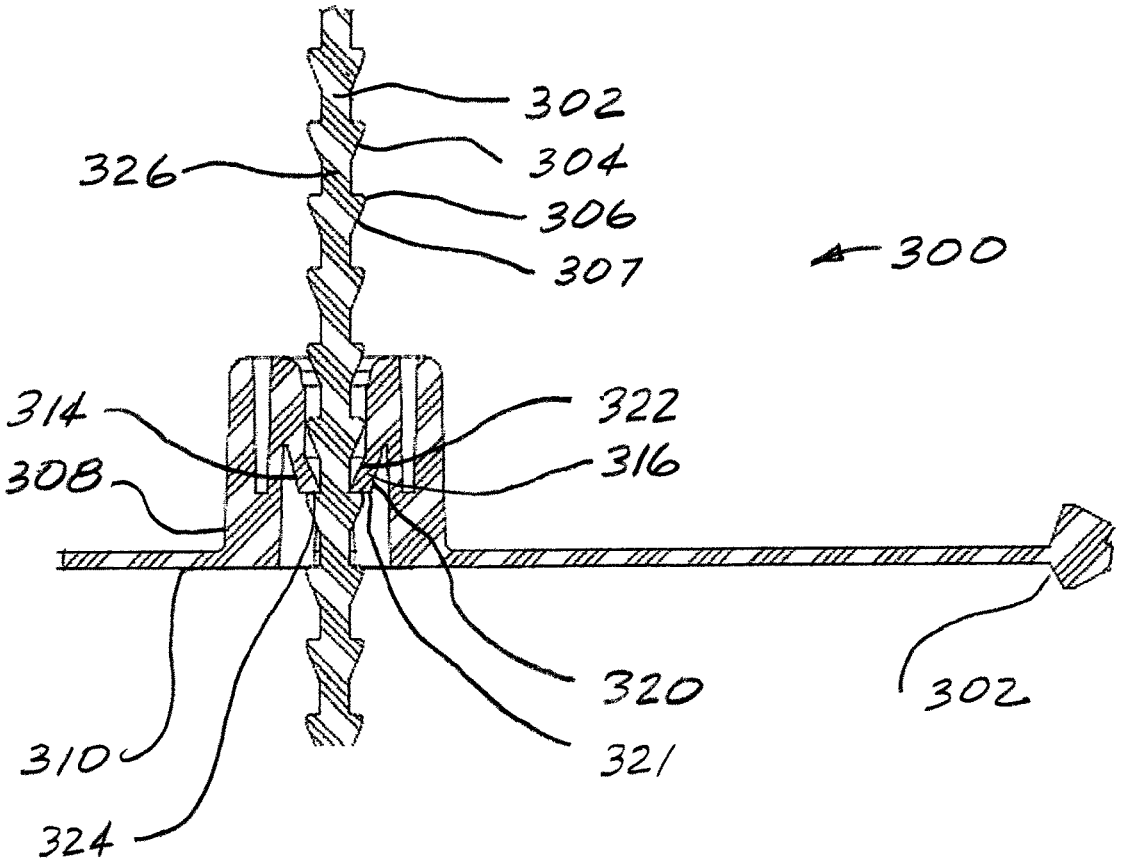
FIG. 22 is a fragmentary cross-sectional view taken along the line 22-22 of FIG. 21.
Figure 23:
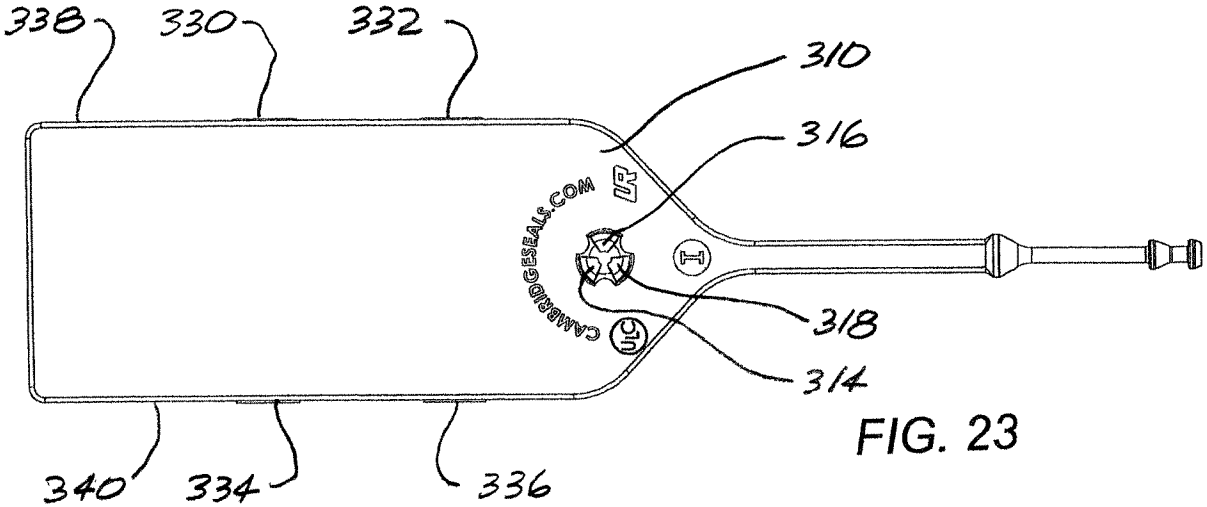
FIG. 23 is a fragmentary bottom view of the seal of FIG. 15 drawn to an enlarged scale.
Figure 24:
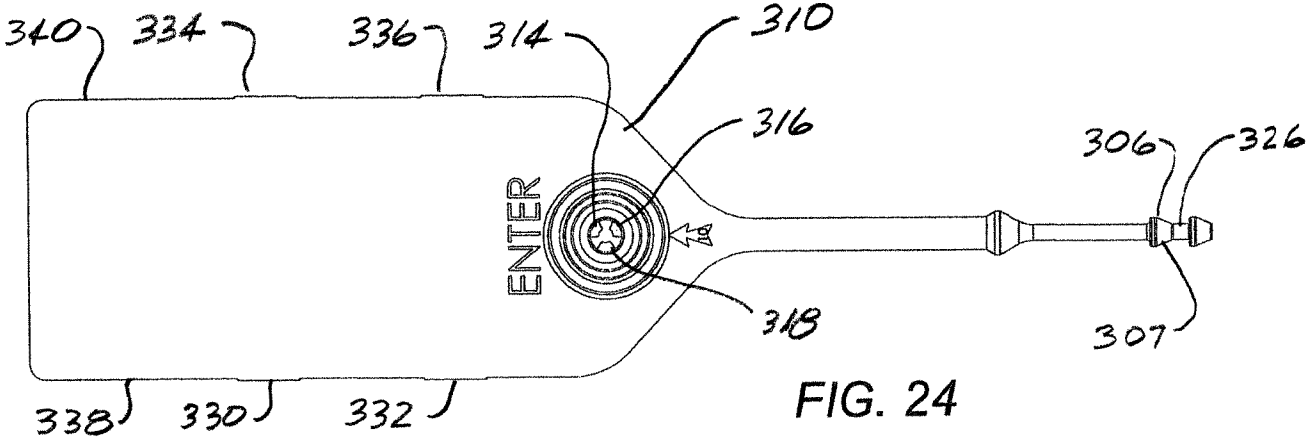
FIG. 24 is a fragmentary top view of the seal of FIG. 17 drawn to an enlarged scale.

A locking barrel 308 which is integrally formed on the tag portion 310 includes a set of three identical equally spaced locking teeth 314, 316, 318, two of which 314, 316 are shown in FIG. 22. The three locking teeth 314, 316, 318 are best shown in FIGS. 23 and 24. Each of the locking teeth 314, 316, 318 has the general configuration of a cantilever with a projecting end 320. The projecting end 320 has a flat portion 321 and the teeth 314, 316, 318 each have an inwardly tapering portion 322. The inwardly tapering portion 322 and the flat portion 321 form a sharp edge 324.

Figure 21:
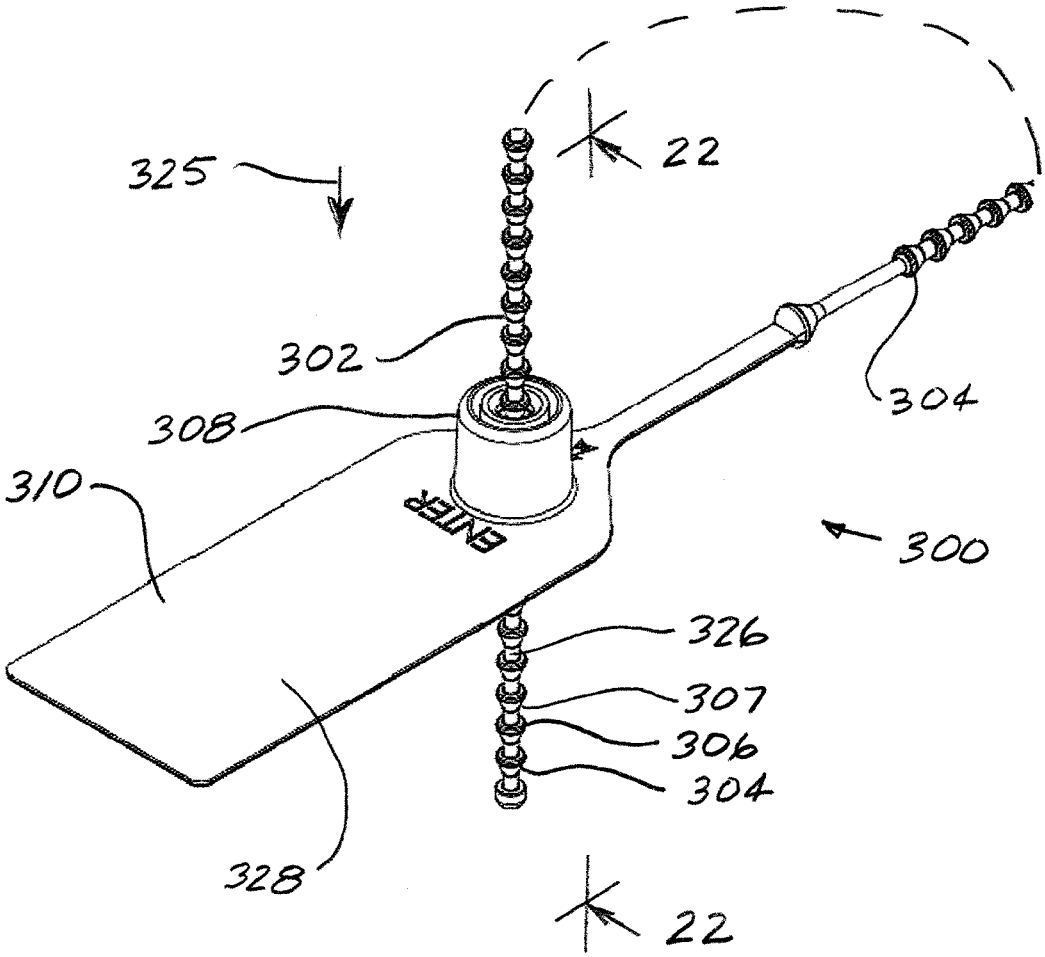
FIG. 21 is a fragmentary perspective view of the seal of FIG. 15 showing the seal in us.

The ramp-like portions 304 enable a user to insert the elongated strap portion 302 into the locking barrel 308 and by exerting a force in the direction shown by the arrow 325 in FIG. 21 and press the ramp-like portions 304 past the locking teeth 312, 314 as shown in FIG. 22. Once past the widest portion of the conical ramp-like portion, the locking teeth 312, 314 snap onto the cylindrical portion 326 and the flat portion 321 of the locking teeth bears against the base portion 306 of the conical ramp-like portion 304 and prevents removal of the elongated strap portion 302 from the locking barrel 308 without damaging the seal and thereby creating a tamper evident condition.

The locking barrel 308 projects upwardly from a flat tag portion 310 which is formed on the end of the elongated strap portion 302. The flat surface 328 provides a convenient location for identification indicia.

As is best shown in FIG. 22, the elongated strap portion 302, the locking barrel 308, the locking teeth 314, 316, 318 and the flat portion 310 are integrally formed using a molding process. The security seal 300 shown in FIGS. 15-24 is thus formed as single unitary member using a plastic material.

FIGS. 23 and 24 have been drawn to an enlarged scale to permit illustration of the locking teeth 314, 316, 318 and the extremely small and thin tabs 330, 332, 334, 336, which are formed on the edges 338, 340 of the tag portion 310. During manufacture multiple seals 300 are molded simultaneously with adjacent seals 300 formed attached to each other via tabs 330, 332, 334, 336. In FIGS. 23 and 24 the tabs 330, 332, 334, 336, have been broken away from like tabs formed on adjacent seals to separate the seal for use.

The foregoing specific embodiments of the present invention as set forth in the specifications herein are for illustrative purposes only. Various deviations and modifications may be made within the spirit and space of this invention, without departing from a main theme thereof.

What we claim is:

1. A tamper evident security seal comprising:

a. an elongated body having a first end, a second end and an intermediate portion, the intermediate portion having a first major flat surface and a second major flat surface, the first and second major flat surfaces being on opposite faces of the intermediate portion, b. a hollow locking barrel disposed on said first end, with said locking barrel having a top opening a locking cap disposed on said second end, an area of reduced dimensions disposed adjacent to said locking cap, said area of reduced dimensions being defined by a conical portion formed of said elongated body with said conical portion having a larger diameter and a smaller diameter with said small diameter disposed proximate to said locking cap and with said larger diameter disposed proximate to said intermediate portion, one or both of the first and second major flat surfaces bearing identification indicia between the locking barrel and the locking cap, c. a plurality of flexible locking teeth disposed in said locking barrel with said locking teeth proportioned to accept insertion of said locking cap into said hollow locking barrel and to prevent withdrawal of said locking cap from said locking barrel after insertion, with said locking teeth each having a distal end and with said distal ends of said locking teeth flexing to accept insertion of said second end into said barrel and snapping into said area of reduced dimension thereby preventing withdrawal of said locking cap and said second end of said elongated body from said locking barrel; and d. a pair of ramp areas disposed proximate to said larger diameter of said conical portion, said ramp areas being defined by a pair of concave portions formed adjacent on said first and second major flat surfaces ending in a common circumferential flange having a pair of flat parallel portions, and a plurality of spaced apart projections formed on said ramp areas, each of said projections formed as a truncated cone with a flat top portion.

2. A tamper evident security seal comprising:

a. an elongated body having a first end, a second end and an intermediate portion, the intermediate portion having a first major flat surface and a second major flat surface, the first and second major flat surfaces being on opposite faces of the intermediate portion, b. a hollow locking barrel disposed on said first end, with said locking barrel having a top opening, a locking cap disposed on said second end, an area of reduced dimensions disposed adjacent to said locking cap, said area of reduced dimensions being defined by a conical portion formed of said elongated body with said conical portion having a larger diameter and a smaller diameter with said small diameter disposed proximate to said locking cap and with said larger diameter disposed proximate to said intermediate portion, one or both of the first and second major flat surfaces bearing identification indicia between the locking barrel and the locking cap, c. a plurality of flexible locking teeth disposed in said locking barrel with said locking teeth proportioned to accept insertion of said locking cap into said hollow locking barrel and to prevent withdrawal of said locking cap from said locking barrel after insertion, with said locking teeth each having a distal end and with said distal ends of said locking teeth flexing to accept insertion of said second end into said barrel and snapping into said area of reduced dimension thereby preventing withdrawal of said locking cap and said second end of said elongated body from said locking barrel; and d. one or more holes of a selected size traversing through a width of the elongated body and arranged adjacent the locking cap.

* * * * *